United States Patent [19]
Whitefield
[11] 4,320,683
[45] Mar. 23, 1982

[54] ASYNCHRONOUS INTERFACE FOR KEYING ELECTRONIC MUSICAL INSTRUMENTS USING MULTIPLEXED NOTE SELECTION

[75] Inventor: John T. Whitefield, Harleysville, Pa.

[73] Assignee: Allen Organ Company, Macungie, Pa.

[21] Appl. No.: 111,613

[22] Filed: Jan. 14, 1980

[51] Int. Cl.[3] ..... G08C 9/00; G10F 5/00
[52] U.S. Cl. ..... 84/115; 340/365 S
[58] Field of Search ..... 84/1.01, 1.03, 115, 84/462, DIG. 29; 340/365 R, 365 S

[56] References Cited

U.S. PATENT DOCUMENTS

| | | | |
|---|---|---|---|
| 3,604,299 | 9/1971 | Englund | 84/1.03 |
| 3,610,799 | 10/1971 | Watson | 84/1.01 |
| 3,872,766 | 3/1975 | Fukui | 84/115 |
| 3,889,568 | 6/1975 | Amaya | 84/1.01 |
| 3,894,463 | 7/1975 | Rocheleau | 84/1.01 |
| 3,905,267 | 9/1975 | Vincent | 84/115 |
| 4,078,465 | 3/1978 | Wheelwright | 84/1.01 |
| 4,129,055 | 12/1978 | Whittington et al. | 84/1.01 |
| 4,134,320 | 1/1979 | Oya | 84/1.01 |

*Primary Examiner*—S. J. Witkowski
*Attorney, Agent, or Firm*—Seidel, Gonda, Goldhammer, & Panitch

[57] ABSTRACT

An asynchronous interface includes two memories which store multiplexed keyboard information such that while one memory is writing in newly acquired key information from one musical instrument system at the clock rate of that system, the other memory is reading out previously acquired key information to a second musical instrument system at the clock rate of the second system. Periodically, based on timing signals derived from both systems, the read/write roles of the two memories are reversed. Any number of asynchronously clocked systems, each connected to an associated asynchronous interface, may be keyed by a single key multiplexing device or by the multiplexing information from another asynchronous interface.

22 Claims, 10 Drawing Figures

SEND SYNC. (SS)

SSD (OUTPUT OF INVERTER 56)

$\overline{SS}$ (OUTPUT OF INVERTER 54)

RECEIVE SYNC (RS)

$\overline{RS}$ (OUTPUT OF INVERTER 58)

SSL (Q OUTPUT OF FF 46)

$\overline{SSL}$ (Q OUTPUT OF FF 46)

RSG (Q OUTPUT OF FF 48)

SSC (OUTPUT OF GATE 52)

RSA (OUTPUT OF GATE 50)

BE (Q OUTPUT OF FF 26)

AE ($\overline{Q}$ OUTPUT OF FF 26)

SCG (OUTPUT OF GATE 60)

ASYNCHRONOUS INTERFACE FOR KEYING ELECTRONIC MUSICAL INSTRUMENTS USING MULTIPLEXED NOTE SELECTION

BACKGROUND OF THE INVENTION

The present invention is directed to an asynchronous interface for use between two electronic musical instruments, each of which employs a digital multiplexed keying scheme. The keying of one instrument is made responsive to the keying information from the other instrument although the two instrument clocks are asynchronous.

In the construction of electronic musical instruments, namely electronic digital organs, it is often desirable to utilize a basic building block approach for creating a varied product line. Aside from the manufacturing advantages of such an approach, there are significant musical advantages as well. The warmth and richness of the string section in a symphony orchestra is due in part to the multiplicity of like instruments, each contributing a uniquely different quality to the total sound. In musical terms this is referred to as ensemble. Ensemble is a very important consideration when building an electronic musical instrument to simulate the sound of a multi-rank pipe organ. A significant contribution to the ensemble quality of an electronic organ has been the use of multiple systems where each system maintains an independence of sound quality.

In completely digital tone generation systems, such as the Allen digital computer organ, each system has its own independent clock and voicing specification along with other qualities important to ensemble. The keying of such a system utilizes digital time division multiplexing, the timing being derived from the system clock. It is not possible to key two or more such systems from a single set of keys by connecting the systems in parallel because the independently clocked systems would interact adversely.

In the past there have been two approaches to the problem of keying such multiple systems. One approach is to have more than one set of key contacts per note so that each independent system has its own set of controls. This method is not only costly to implement but costly insofar as the time required to adjust the many key contacts involved. This approach becomes more impractical as the number of paralleled systems increases.

The second approach to the problem is to use interface devices called keyers. A keyer is an array of electronic switches where each key of the organ is wired to one electronic switch in the array. The output of the array accepts the multiplexing signals from its associated system. Since the key switches operate in a DC mode, any number of keyers may be connected to one set of key contacts. The disadvantage of this method of keying is the significant amount of wiring required i.e., one wire per key per system. This approach is not only costly to implement due to extensive wiring, but costly in terms of the space required to house the many keys required in a large organ system.

It is an object of the present invention to eliminate those disadvantages noted above by providing an asynchronous serial interface between two independently clocked digital organ systems which employ multiplexed keyboard information, where only one system interacts directly with the key switches.

BRIEF SUMMARY OF THE INVENTION

An asynchronous serial interface receives multiplexed key pulse (MKP) information at a first clock rate from a first electronic musical system and converts the rate of the MKP information to a second rate. The rate converted MKP information is used to key a second electronic musical instrument which normally generates its own MKP information at the second rate. The interface includes a pair of memories. MKP information from the first musical instrument is stored (written) in one memory at the first clock rate while MKP information (emanating from the first musical instrument) which was previously stored in the other memory is retrieved (read) from that memory at the second rate. The storage (at the first rate) and retrieval (at the second rate) of MKP information is periodically reversed between the memories. The information retrieved from both memories is combined to form the rate converted MKP information for keying the second instrument.

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

The asynchronous interface of the instant invention is intended for use between two digital electronic musical instruments, or between a key switch or keyboard multiplexer and a digital electronic musical instrument, whose operation is consistent with the teachings of U.S. Pat. No. 3,610,799 relating to the multiplexing of key switch information.

In such an instrument, the key switches of a (four division) keyboard are scanned one at a time in serial fashion by the instrument's keyboard multiplexer to create a time division multiplexed pulse stream representative of key switch activity. The complete four division scan is divided into a multiplicity of equally spaced key time slots whose position in the over-all scan sequence is uniquely associated with a particular key switch. The presence of a pulse in any time slot identifies a particular key as being played (depressed); the absence of a pulse signifies the inactive (undepressed) state of a key.

Keyboard Multiplexer

For ease of reference, the operation of a conventional keyboard multiplexer is described herein, it being understood, that the structure and function of the multiplexer is well-known, being described for example in U.S. Pat. No. 3,610,799.

The keyboard multiplexer comprises a series of connected counters, referred to collectively as the keyboard counter. The keyboard counter is clocked by a master clock. The counter outputs represent various segments of the keyboard scan sequence.

Figure 1:
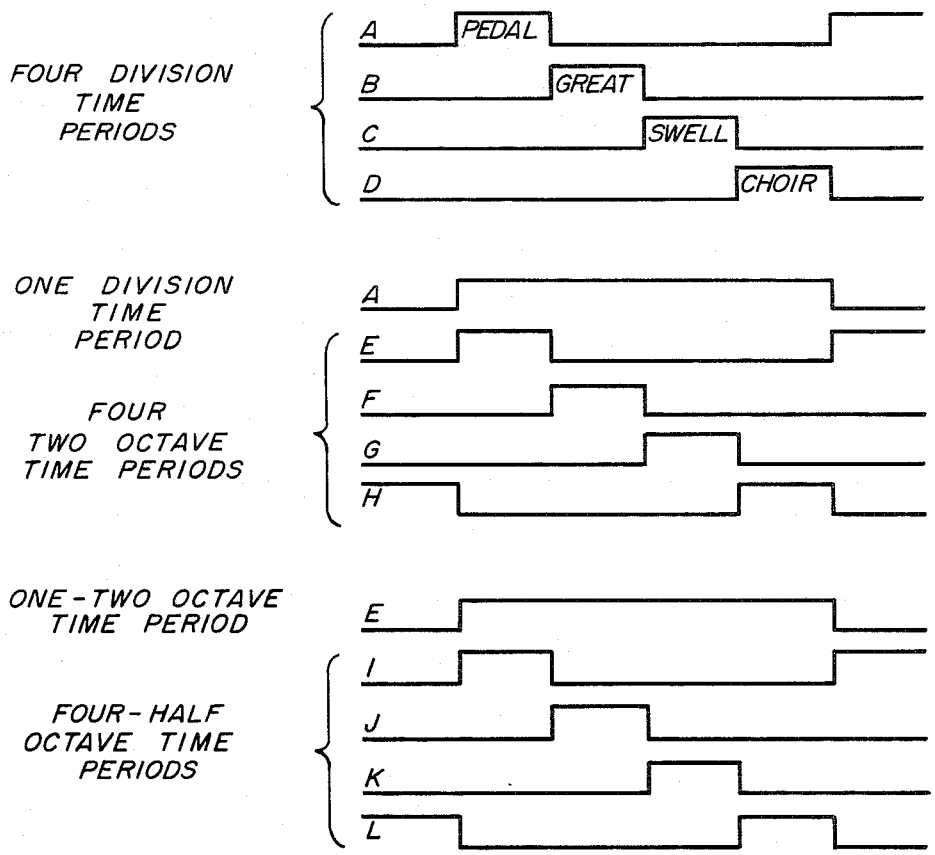
FIG. 1 is a diagram showing the timing of the keyboard counter signals.

Referring to FIG. 1, the keyboard counter pulse outputs A, B, C, and D indicate that portion of the keyboard scan associated with the four divisions of the electronic musical instrument (PEDAL, GREAT, SWELL, CHOIR). In particular, each division pulse represents the time during which one of the divisions is being scanned.

Each division pulse is subdivided into four equal parts as indicated by keyboard counter pulse outputs E, F, G, and H. Each of these pulses represents the time during which a two-octave grouping of key switches is being scanned within the division. Each two octave scan period is further divided into half octave time periods as indicated by the keyboard counter pulse outputs I, J, K, and L.

Figure 2:
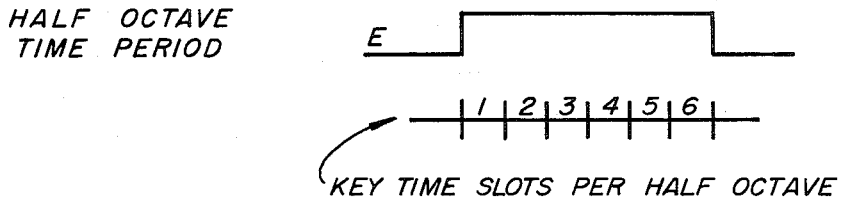
FIG. 2 is a diagram showing the relationship between half-octave pulses and key time slots.

Referring to FIG. 2, each half octave time period is further divided into 6 key time slots 1–6, each slot representing the scan period for an associated key in the half octave group of keys. Accordingly, each division pulse corresponds to a scan of 16 half octaves or, at 6 keys per half octave, 96 keys, each key being assigned a unique slot within the division pulse.

As the standard organ keyboard has a maximum of 61 keys for a manual division (GREAT, SWELL, CHOIR) and 32 keys for the PEDAL division, there are several half octave time periods not used by the keyboard multiplexer for the production of the multiplexed keyboard information. In the preferred embodiment herein, one of the unused half octave pulses is used as a scan reference indicator or SYNC pulse as described hereinafter.

The keyboard multiplexer also includes a decoder, switch array and encoder. The timing signals described above are applied to the decoder. The decoder outputs are connected to the key switch array. The outputs of the key switch array along with certain outputs from the keyboard counter are applied to the encoder. The encoder generates the serial time division multiplexed representation of key switch activity. This output is referred to hereinafter as the MULTIPLEXED KEY PULSES or MKP information.

In addition to the above described timing information, each key time slot is divided into twelve equal time periods, referred to as bit times, designated BT01 through BT12, BT01 being the first bit time in a key time slot and BT12 being the last bit time in the slot. See FIG. 3. The period of each BT pulse signal is the length of a key time slot.

Asynchronous Interface

The asynchronous interface of the present invention accepts multiplexed key pulse (MKP) information from one instrument (or system) at one clock rate (BT pulse rate of the instrument) and reproduces the same information for use by another instrument (or system) at another clock rate (BT pulse rate of that instrument). The system which generates the original MKP information (at its BT pulse rate) is referred to hereinafter as the SEND SYSTEM; the system which receives the rate converted MKP information (at its BT pulse rate) is referred to as the RECEIVE SYSTEM.

Figure 4A:
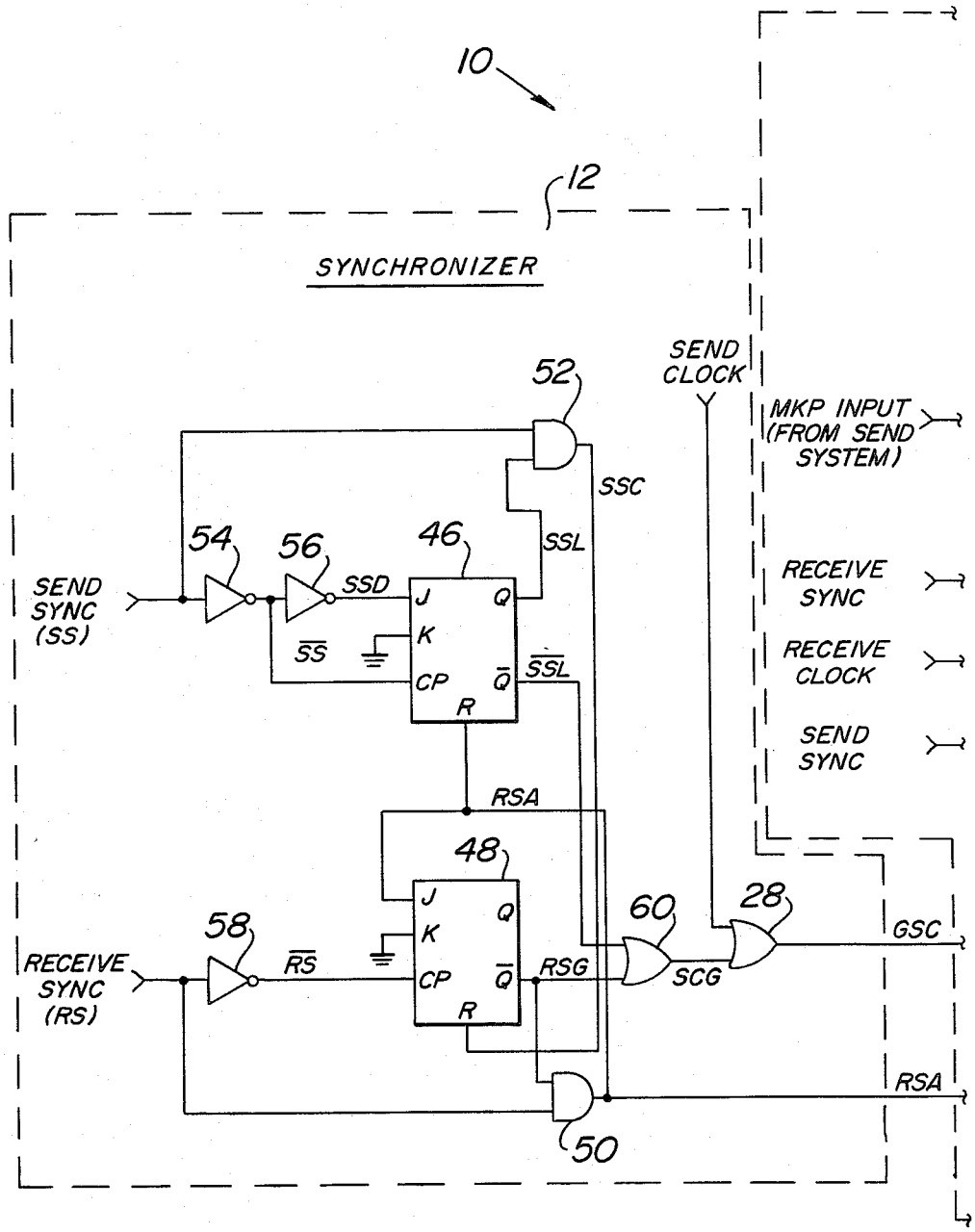
FIGS. 4A and 4B comprise a block diagram of the asynchronous interface of the present invention.
Figure 4B:
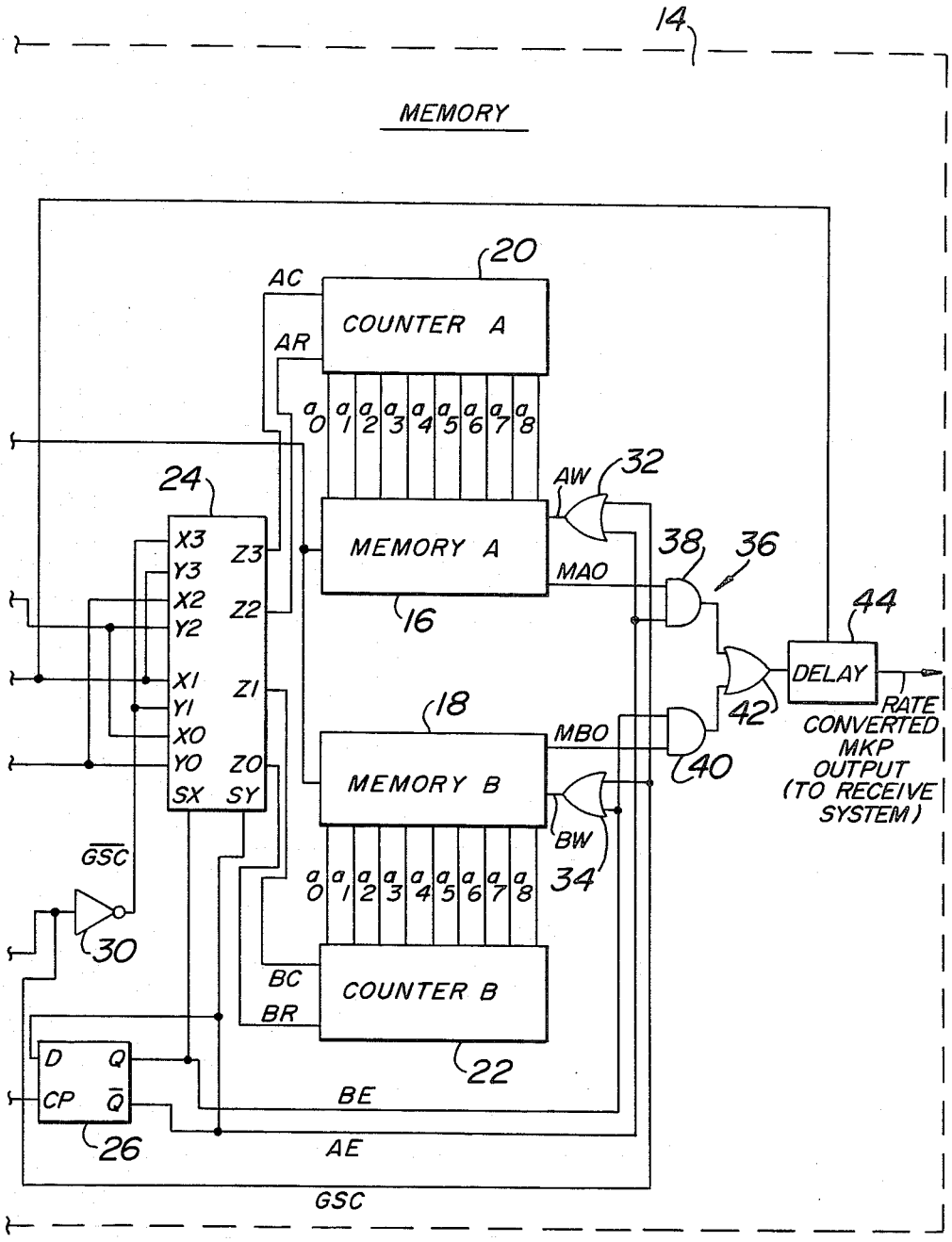

Referring to the drawings, wherein like numerals indicate like elements, there is shown in FIGS. 4A and 4B the asynchronous interface of the present invention, designated generally as 10. The asynchronous interface comprises two sections as indicated by the logic enclosed in dotted lines. The two sections are identified as synchronizer section 12 and memory section 14.

The memory section section 14 comprises two memory devices 16, 18 and associated logic. The memories 16, 18 function in a complementary fashion, that is, when data is being written into one memory, data is being read out of the other memory. Periodically, under control of the synchronizer section 12, the roles of the two memories will be reversed. While data is always written into one of the memories at the data rate (BT pulse rate) of the send system, data is read out of the other memory at the data rate (BT pulse rate) of the receive system. The transition from write to read always occurs at the same relative point in the overall scan sequence (MKP) of the receive system.

The synchronizer section 12 maintains order in the entire process by monitoring synchronizing (SEND SYNC) pulses that originate from the send system and synchronizing pulses (RECEIVE SYNC) that originate from the receive system. The SEND SYNC pulse signifies the beginning of the keyboard scan sequence for the send system while the RECEIVE SYNC pulse signifies the beginning of the keyboard scan sequence for the receive system. The term "scan sequence", as applied to the send system, refers to the timing signals (FIGS. 1–3) which are directly associated with the scanning of keys of the send system at the send system scan rate (BT pulse rate of send system). The same term, as applied to the receive system, refers to the timing signals (whose relationship is also shown generally in FIGS. 1–3) which are directly associated with the scanning of keys of the receive system at the receive system scan rate (BT pulse rate of receive system). In terms of memory function, the SEND SYNC signal signifies the beginning of a write cycle while the RECEIVE SYNC signal signifies the beginning of a read cycle.

Memory Section 14

Referring to FIGS. 4A and 4B, each memory device 16, 18 is a $1 \times n$ RAM whose address lines a0 through a8 are connected respectively to modulo n binary counters 20 and 22. The value of n can be any convenient number which is equal to or greater than the total number of key time slots in each scan sequence, since as described hereinafter the counters will be reset at the correct count regardless of excess capacity. In the preferred embodiment, the total number of key time slots is 384 (although this is not a limiting number) and the value of n is 1024 so that memories 16 and 18 can be standard RAMs such as the AMD 9102. Counters 20 and 22 are equivalent to the negative edge triggered CMOS 4040 counter. The data inputs of both memories are tied together and receive the serial MKP information from the send system. The clock (AC, BC) inpus and reset (AR, BR) inputs to counters 20 and 22 are connected to data selector 24 output lines Z3, Z1 and Z2, Z0 respectively. Data selector 24 serves as a four-pole two position electronic switch and may be a CMOS 4019 digital multiplexer. The control inputs SX and SY of the data selector 24 are connected to the complementary lines AE ($\overline{Q}$ output of flip-flop 26) and BE (Q output of flip-flop 26).

The X and Y inputs to the data selector are connected to two sets of clock and reset signals. The clock from the receive system is labeled RECEIVE CLOCK, and the reset from the receive system is labeled RECEIVE SYNC. The clock from the send system, as seen by data selector 24, is denoted $\overline{GSC}$ and is the SEND CLOCK gated by OR gate 28 and inverted by inverter 30. The reset from the send system is labeled SEND SYNC.

Based on the state of the SX and SY inputs to data selector 24, one counter 20, 22 receives the send system clock and reset signals while the other counter 22, 20 receives the receive system clock and reset signals as indicated in Table 1 below.

TABLE 1

| SX | SY | CLOCK AC | RESET AR | CLOCK BC | RESET BR |
|---|---|---|---|---|---|
| 0 | 1 | RECEIVE CLOCK | RECEIVE SYNC | $\overline{GSC}$ | SEND SYNC |
| 1 | 0 | $\overline{GSC}$ | SEND SYNC | RECEIVE CLOCK | RECEIVE SYNC |

Each memory has a read/write control input. The memory 16 read/write control input is connected to the output of OR gate 32 via line AW; the memory 18 read/write control input is connected to the output of OR gate 34 via line BW. One input of each OR gate 32, 34 is connected to the output of OR gate 28 which generates the GSC signal. The second input to gate 34 is connected to the Q output of flip-flop 26 via the BE line; the second input to gate 32 is connected to the $\overline{Q}$ output of flip-flop 26 via the AE line. Gates 32 and 34 serve as write enable gates for the memories 16 and 18 respectively. Data is written into a memory 16, 18 when, during a given address time, the corresponding write line AW, BW goes low.

The memory section 14 also includes an AND-OR circuit 36 comprising AND gates 38, 40 and OR gate 42. The AND-OR circuit 36 acts as a single pole double throw switch whose control inputs are the BE and AE lines and whose signal inputs are the memory output lines MAO and MBO which carry the rate converted MKP information. The output from OR gate 42 is delayed one complete RECEIVE CLOCK period (one receive system BT period or key time slot) by delay element 44. Element 44 may be a shift register (clocked by RECEIVE CLOCK) as is well known in the art. The output of element 44 is sent to the receive system as the rate converted MKP information.

Data selector 24, gates 32 and 34, and gates 38 and 40 are controlled by the complementary lines BE and AE (Q and $\overline{Q}$ outputs of flip-flop 26). Flip-flop 26, a D-type flip-flop having its $\overline{Q}$ output returned to its D input, is similar to the CMOS 4013 and toggles on the positive going edge of the RSA signal received from the synchronizer section 12.

If the BE line is low initially, and the AE line is high, a positive going RSA signal will cause flip-flop 26 to toggle such that the BE line goes high and the AE line goes low. Counter 20 is therefore reset to a zero address by the SEND SYNC signal which is passed by data selector 24 to the reset input of the counter via the AR line. After being reset, counter 20 receives GSC pulses which are passed by the data selector to the clock input of the counter via the AC line. Also at this time gate 32 is enabled by the low AE line and propagates the $\overline{GSC}$ pulses to the read/write control input of memory 16. Memory 16 therefore receives address information from counter 20 at the $\overline{GSC}$ clock rate (the SEND CLOCK rate) as well as write data in the form of MKP information from the send system. The MKP information (binary 0s or 1s) is written into the memory at the addresses specified by counter 20 at the SEND CLOCK rate. The writing sequence continues until the next SEND SYNC pulse resets the counter. At the time the SEND SYNC pulse resets counter 20, the memory 16 will have stored MKP information corresponding to one complete scan. From this point on, $\overline{GSC}$ and GSC are held at fixed logic levels and no longer serve as clock and write memory controls, respectively, as described more fully below. Memory 16 then remains static or inactive until the synchronizer section 12 causes it to be placed in the read mode.

Concurrently, counter 22 is reset by the RECEIVE SYNC signal passed by data selector 24 to the BR line and is clocked by the RECEIVE CLOCK passed by the data selector to the BC line. Memory 18 is placed in the read mode by virtue of a high level on the BE line and, accordingly, a high level on the BW line through gate 34. As counter 22 counts, it addresses memory 18 and the information stored in memory 18 (from a previous write cycle) is read out of the memory and serially trasmitted on the MBO line, through gates 40, 42, and delay element 44, to the receive system as the rate converted MKP information.

On receipt of the next RECEIVE SYNC signal, an RSA pulse is generated as described more fully below. The RSA signal toggles flip-flop 26 once again. Accordingly, the Q and $\overline{Q}$ outputs of the flip-flop change state. This will reverse the read-write roles of memories 16 and 18. The above read/write process is repeated with the roles of the memories reversed.

Synchronizer Section 12

The synchronizer section 12 includes two JK flip-flops 46, 48, similar to the CMOS 4027, and several logic gates. See FIG. 4A. The K inputs of the flip-flops are permanently held low, as indicated by the ground symbol, so that any high level signal on the K input of a flip-flop, coincident with a clock pulse (CP), will cause the Q output of the flip-flop to be set high. Once set, the Q output will remain high regardless of any change in the level of the J input until the flip-flop is reset as described hereinafter. Resetting of the flip-flops can only be accomplished by a high level at the R input of the flip-flop.

Figure 5:
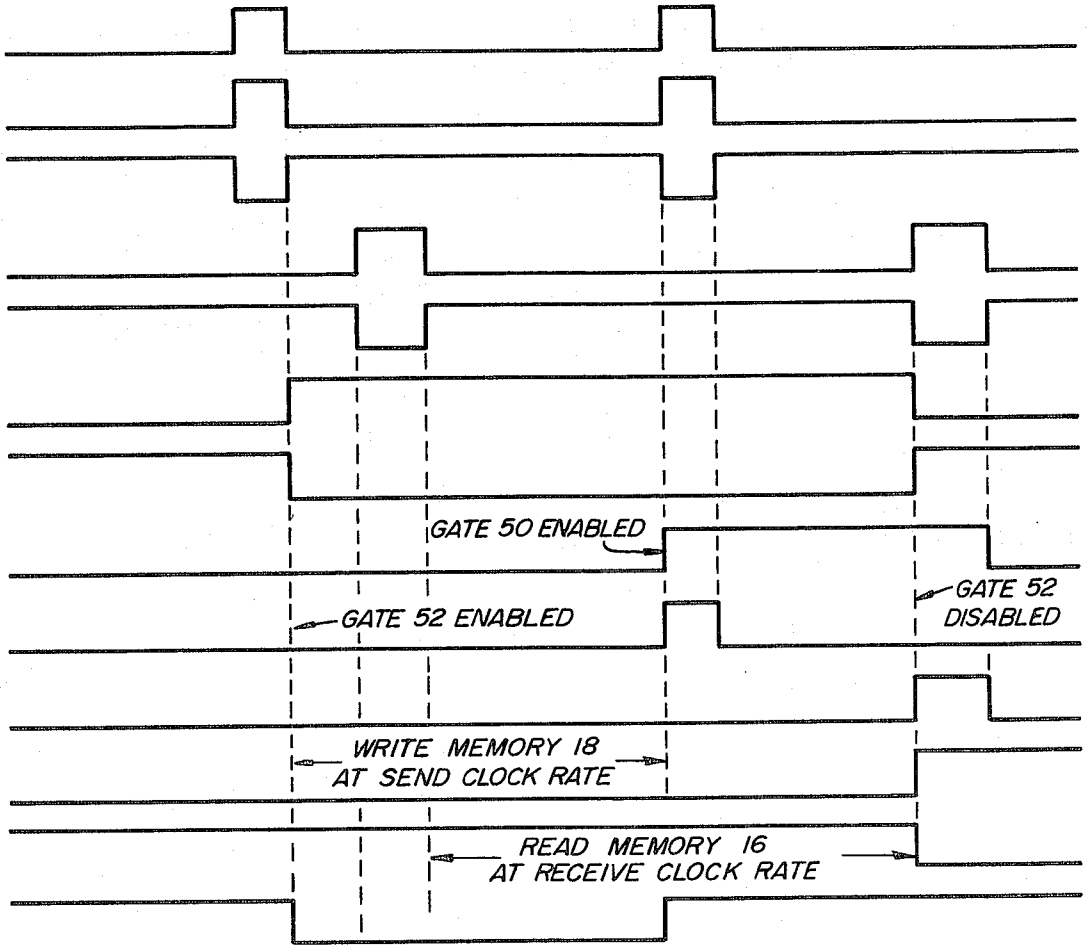
FIG. 5 is a diagram showing the timing of the asynchronous interface signals.

Referring to FIG. 5, it will be assumed for purposes of explanation that flip-flop 46 is in the reset state (Q output low) and that flip-flop 48 is in the set state ($\overline{Q}$ output low). Under these conditions, AND gate 50, one input of which is low by virtue of the RSG line (connected to $\overline{Q}$ output of flip-flop 48) being low will block any RECEIVE SYNC pulses from appearing on its RSA output. Accordingly, the RSA output of AND gate 50 will be low. A high RSA signal asynchronously resets flip-flop 46 (Q output low) via the R input of the flip-flop regardless of presence or absence of a valid clock signal ($\overline{SS}$ pulse) at the CP input and a high RSA signal synchronously sets flip-flop 48 ($\overline{Q}$ output low) via the J input of the flip-flop in the presence of a valid clock signal (positive going edge of $\overline{RS}$ pulse) at the CP input. A positive going transition of the RSA signal also toggles flip-flop 26 to reverse the read-write roles of memories 16, 18 in memory section 14.

Flip-flop 48 and the RSA signal, however, will not change state until the SSC output of AND gate 52 places a high on the reset input (R) of flip-flop 48 to asychronously reset the flip-flop. Flip-flop 46 being assumed in the reset state (Q output low), but with its R input low (disabled), will change state in response to a positive going SSD pulse (at the J input of the flip-flop) generated by series connected inverters 54 and 56 based on a positive going SEND SYNC pulse. Thus, the SS output of inverter 54 is the inverted SEND SYNC signal and is applied to the clock input (CP) of flip-flop 46. On the negative going (trailing) edge of the SEND SYNC pulse, the SS pulse will have a positive going edge. This positive going edge clocks the high SSD signal into flip-flop 46 (Q output high). Due to the propagation delay of inverters 54, 56, and flip-flop 46, the Q output (SSL) of the flip-flop will rise to a high level after occurrence of the negative going (trailing) edge of the SEND SYNC pulse i.e. after the SEND SYNC pulse has returned to a low level. The high SSL level appears at one input of AND gate 52. The other input to AND gate 52 is the SEND SYNC signal which is now low. Accordingly, the SSC output of AND gate 52 will be unaffected by the high level of SSL. Gate 52, however, is now in an enabled state so that the gate will propagate the next SEND SYNC pulse as a positive going pulse on the SSC line.

The positive going SSC pulse resets flip-flop 48, causing the $\overline{Q}$ output of the flip-flop to go high. Accordingly, AND gate 50 is enabled. With AND gate 50 enabled, the next positive going RECEIVE SYNC pulse will be propagated by the AND gate to the RSA line as a positive going pulse. The positive going RSA pulse will cause three events to take place. First, the pulse resets flip-flop 46 which in turn disables AND gate 52 (SSL low). Second, the pulse toggles flip-flop 26, interchanging read and write functions between memories 16, 18. Third, the pulse allows flip-flop 48 to be set (J input high) on the negative going (trailing) edge of the RECEIVE SYNC pulse, i.e. on the positive going (trailing) edge of the inverted RECEIVE SYNC pulse (denoted $\overline{RS}$) generated by inverter 58 at the clock input (CP) of the flip-flop.

The $\overline{Q}$ outputs of flip-flops 46 and 48 are applied to the $\overline{SSL}$ and RSG inputs of OR gate 60. See FIG. 4A. The levels on these two inputs will be simultaneously low for one and only one MKP scan cycle of the send system. When both inputs are low, the SCG output of OR gate 60 is low. The SCG output of OR gate 60 is connected to one input of OR gate 28. The other input of OR gate 28 receives the SEND CLOCK. When the SCG line is low, the GSC output of OR gate 28 is a burst of SEND CLOCK pulses. These pulses are transmitted to the memory section 14 to accomplish the writing function.

The data selector 24 ensures that the MKP information for one complete send system scan sequence will be written into the appropriate memory 16, 18 at the SEND CLOCK rate while data corresponding to the previous send system scan sequence is read out of memory 18, 16 at the RECEIVE CLOCK rate. The read/-write process will be completed by the time that flip-flop 26 is toggled to reverse the read-write roles of the memories. This prevents the possibility of an error being written into memory 16, 18 if the toggling action were allowed to occur during a write cycle. The setting and resetting of flip-flops 46 and 48 by the RSA pulse signifies the end of one complete cycle of operation of the synchronizer section 12.

Figure 6:
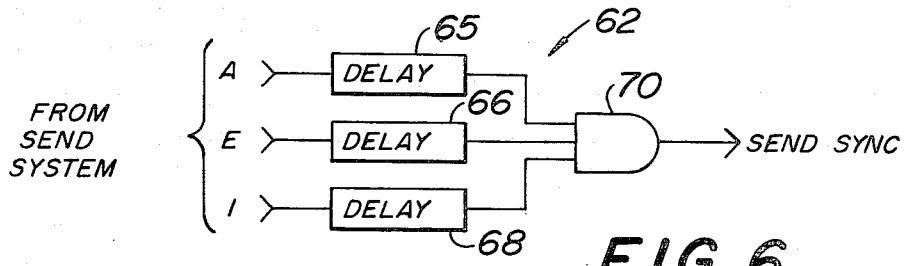
FIG. 6 is a block diagram of a circuit used to generate the SEND SYNC signal.
Figure 7:
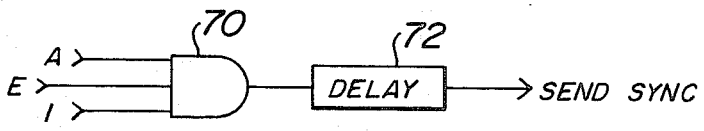
FIG. 7 is a block diagram of another circuit used to generate the SEND SYNC signal.

A circuit 62 for generating the SEND SYNC signal from the send system is shown in FIG. 6. The generation of SEND SYNC is accomplished by applying the division signal A, the two octave signal E and the half octave signal I (as shown in FIG. 1) to three delay elements 64, 66, 68, respectively, each of which produces a one key time slot delay. The delay elements are identical and may take the form of a shift register or other delay device well known in the art. The output of each delay element goes to one input of a three input AND gate 70. The output of gate 70 is the desired SEND SYNC signal and occupies one of the unused half octave time periods shown in FIG. 1. The delay elements are used to align the SEND SYNC signal with the MKP information from the send system. Alternatively, the A, E and I signals may be fed directly to the AND gate 70 and the AND gate output may be delayed by a single delay element 72 as shown in FIG. 7.

Figure 8:
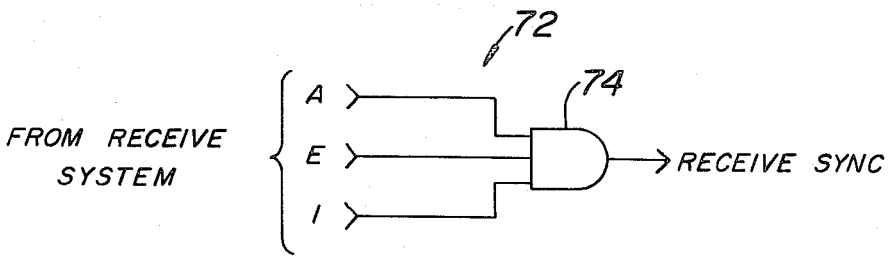
FIG. 8 is a block diagram of a circuit used to generate the RECEIVE SYNC signal.

A circuit 72 for generating the RECEIVE SYNC signal is shown in FIG. 8. The A, E, and I signals (FIG. 1) of the receive system are applied to the three inputs of AND gate 74. The output of gate 74 is the desired RECEIVE SYNC signal.

Figure 9:
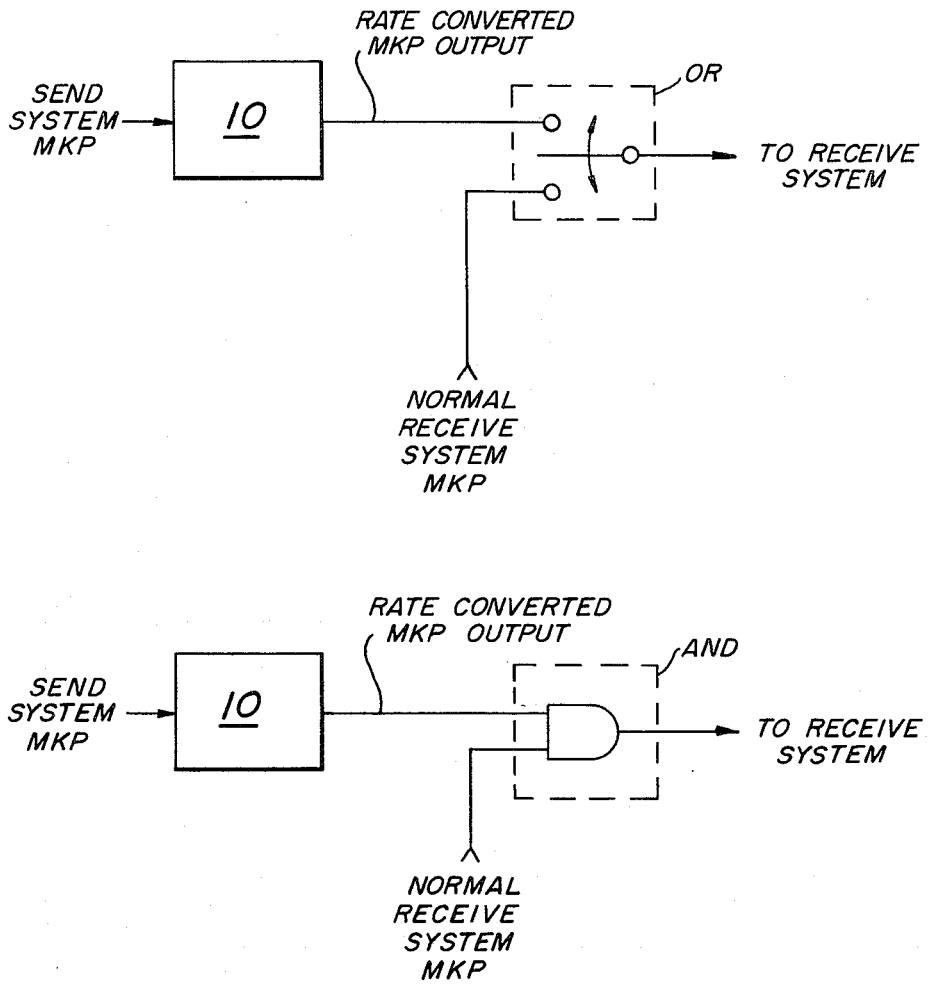
FIG. 9 is a segmented block diagram showing alternative logic circuits for using the rate converted MKP information at the receiving system.

As previously indicated, the proper realignment of the rate converted MKP information with the MKP timing of the receive system is accomplished by delay element 44 (FIG. 4) which delays the rate converted MKP pulse one RECEIVE CLOCK period. The rate converted MKP information is transmitted to the receive system for use by the receive system in generating musical tones in response to the rate converted MKP information. For this purpose, the rate converted information can be ORed or ANDed with the normal MKP stream generated by the receive system as shown in FIG. 9.

Figure 3:
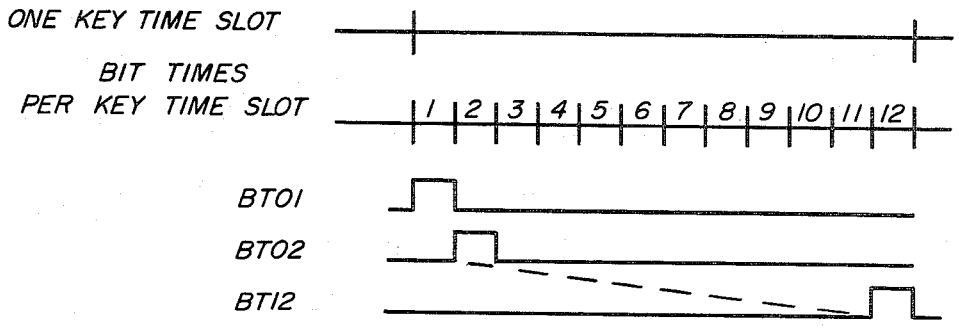
FIG. 3 is a diagram showing the relationship between key time slots and bit times.

The RECEIVE and SEND CLOCKS are preferably the BT01 pulses of the receive and send system respectively (FIG. 3). These pulses have a period which is one key time slot long.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus for keying an electronic musical instrument operable in response to serial multiplexed key pulse information at a first scan rate in accordance with serial multiplexed key pulse information produced asynchronously at a second scan rate which may be the same as or different from the first rate comprising:

at least first and second memories;

means for receiving the multiplexed key pulse information produced at said second rate;

means for alternately storing in each of said memories at said second rate the received multiplexed key pulse information;

means for alternately retrieving from each of said memories at said first rate the multiplexed key pulse information stored therein; and means for combining the multiplexed key pulse information retrieved from said first and second memories to produce multiplexed key pulse information at said first rate for use in keying the electronic musical instrument.

2. Apparatus for keying a first electronic musical instrument operable in response to serial multiplexed key pulse information at a first scan rate in accordance with serial multiplexed key pulse information produced asynchronously by a second electronic musical instrument at a second scan rate which may be the same as or different from the first rate, comprising:

at least first and second memories;

means for receiving the multiplexed key pulse information produced by the second electronic musical instrument at the second rate;

means for alternately storing in each of said memories at said second rate the received multiplexed key pulse information;

means for alternately retrieving from each of said memories at said first rate the multiplexed key pulse information stored therein; and means for combining the multiplexed key pulse information retrieved from said first and said second memories to produce multiplexed key pulse information at said first rate for use in keying the first electronic musical instrument.

3. Apparatus for keying an electronic musical instrument operable in response to serial multiplexed key pulse information at a first scan rate in accordance with serial multiplexed key pulse information produced asynchronously at a second scan rate which may be the same as or different from the first rate, comprising:

at least first and second memories;

means for receiving the multiplexed key pulse information produced at the second rate;

first addressing means for generating a sequence of addresses for said first memory;

second addressing means for generating a sequence of addresses for said second memory;

means for storing at said second rate the received multiplexed key pulse information in said first memory at the addresses generated by said first addressing means during a first interval of time and for storing at said second rate the received multiplexed key pulse information in said second memory at the addresses generated by said second addressing means during a second distinct interval of time;

means for retrieving at said first rate the multiplexed key pulse information stored in said first memory at the addresses generated by said first addressing means during said second interval of time and for retrieving at said first rate the multiplexed key pulse information stored in said second memory at the addresses generated by said second addressing means during said first interval of time; and means for combining the multiplexed key pulse information retrieved from said first and second memories to produce multiplexed key pulse information at said first rate for use in keying the electronic musical instrument.

4. Apparatus according to claim 3 wherein said first addressing means comprises a first counter connected to said first memory and said second addressing means comprises a second counter connected to said second memory.

5. Apparatus according to claim 4 wherein said means for storing includes a data selector circuit for alternately clocking each of said counters at said first and said second rates such that one counter is clocked at one rate while the other counter is clocked at the other rate.

6. An asynchronous serial interface for keying a receive electronic musical system responsive to multiplexed key pulse information generated at a receive scan rate in accordance with multiplexed key pulse information produced asynchronously by a send electronic musical system at a send scan rate which may be the same as or different from the receive scan rate, comprising:

at least first and second memories;

means for receiving the multiplexed key pulse information produced by the send electronic musical system at the send rate;

means for alternately storing in each of said memories at said send rate the received multiplexed key pulse information;

means for alternately retrieving from each of said memories at said receive rate the multiplexed key pulse information stored therein; and means for combining the multiplexed key pulse information retrieved from said first and second memories to produce multiplexed key pulse information at said receive rate for use in keying the receive electronic musical system.

7. Apparatus for converting the timing at which multiplexed key pulse information is produced asynchronously by a first electronic musical instrument to a timing compatible for use in keying a second electronic musical instrument, comprising:

at least first and second memories;

means for receiving the multiplexed key pulse information produced by the first musical instrument;

means for alternately storing said received key pulse information in each of said memories at the timing of the received multiplexed key pulse information;

means for alternately retrieving from each of said memories the multiplexed key pulse information stored therein at the timing compatible with the second electronic musical instrument; and means for combining the multiplexed key pulse information retrieved from said first and second memories to produce multiplexed key pulse information at said timing compatible for use in keying the second electronic musical instrument.

8. Apparatus for keying an electronic musical instrument operable in response to serial multiplexed key pulse information generated at a first scan rate in accordance with serial multiplexed key pulse information produced asynchronously at a second scan rate which may be the same as or different from the first rate, comprising:

at least first and second memories;

means for selectively storing information in said first memory or said second memory;

means for selectively retrieving information from said first memory or said second memory;

means for receiving the multiplexed key pulse information produced at the second rate;

means for causing said means for selectively storing information to store the received key pulse information in one of said first and second memories at said second rate while causing said means for selectively retrieving to retrieve stored multiplexed key pulse information from the other of said first and second memories at said first rate; and means for combining the multiplexed key pulse information retrieved from said first and second memories to produce multiplexed key pulse information at said first rate for use in keying said electronic musical instrument.

9. Method of keying an electronic musical instrument operable in response to serial multiplexed key pulse information generated at a first scan rate in accordance with serial multiplexed key pulse information produced asynchronously at a second scan rate which may be the same as or different from the first rate, comprising:

receiving the multiplexed key pulse information produced at the second rate;

storing the received multiplexed key pulse information in a first memory during a first interval of time and in a second memory during a second interval of time, said first and second intervals of time occurring at said second rate;

retrieving the stored multiplexed key pulse information from said second memory during said first interval of time and from said first memory during said second interval of time; and combining the multiplexed key pulse information retrieved from said first and second memories to produce multiplexed key pulse information at said first rate for use in keying the electronic musical instrument.

10. Method of keying an electronic musical instrument operable in response to serial multiplexed key pulse information generated at a first scan rate in accordance with serial multiplexed key pulse information produced asynchronously at a second scan rate which may be the same as or different from the first rate, comprising:

receiving the multiplexed key pulse information produced at the second rate;

alternately storing the received multiplexed key pulse information in first and second memories at the second rate;

alternately retrieving the stored multiplexed key pulse information from said first and second memories at the first rate; and transmitting the retrieved multiplexed key pulse information to the electronic musical instrument at the first rate.

11. Apparatus according to claims 1, 2, 3 or 8 wherein said first and second rates are different.

12. The asynchronous serial interface according to claim 6 wherein said send and receive rates are different.

13. Method of keying an electronic musical instrument according to claims 9 or 10 wherein said first and second rates are different.

14. Apparatus for converting the timing at which multiplexed key pulse information is produced asynchronously by a key multiplexing device to a timing compatible for use in keying an electronic musical instrument, comprising:

at least first and second memories;

means for receiving the multiplexed key pulse information produced by the key multiplexing device;

means for alternately storing said received key pulse information in each of said memories at the timing of the received multiplexed key pulse information;

means for alternately retrieving from each of said memories the multiplexed key pulse information stored therein at the timing compatible with the electronic musical instrument; and means for combining the multiplexed key pulse information retrieved from said first and second memories to produce multiplexed key pulse information at said timing compatible for use in keying the electronic musical instrument.

15. Method of producing serial key pulse information at a first scan rate in response to serial multiplexed key pulse information produced asynchronously at a second scan rate which may be the same as or different from the first rate, comprising:

receiving the multiplexed key pulse information produced at the second rate;

storing the received multiplexed key pulse information in a first memory during a first interval of time and in a second memory in a second interval of time, said first and second intervals of time occurring at said second rate;

retrieving the stored multiplexed key pulse information from said second memory during said first interval of time and from said first memory during said second interval of time; and combining the multiplexed key pulse information retrieved from said first and second memories to produce multiplexed key pulse information at said first rate.

16. Method of producing serial key pulse information at a first scan rate in response to serial multiplexed key pulse information produced asynchronously at a second scan rate which may be the same as or different from the first rate, comprising:

receiving the multiplexed key pulse information produced at the second rate;

alternately storing the received multiplexed key pulse information in first and second memories at the second rate;

alternately retrieving the stored multiplexed key pulse information from said first and second memories at the first rate; and transmitting the retrieved multiplexed key pulse information at the first rate.

17. Method of producing serial key pulse information at a first scan rate in response to serial multiplexed key pulse information produced asynchronously at a second scan rate which may be the same as or different from the first rate, comprising:

providing at least first and second memories;

receiving the multiplexed key pulse information produced at said second rate;

alternately storing in each of said memories at said second rate the received multiplexed key pulse information;

alternately retrieving from each of said memories at said first rate the multiplexed key pulse information stored therein; and combining the multiplexed key pulse information retrieved from said first and second memories to produce multiplexed key pulse information at said first rate.

18. Method for producing serial key pulse information according to claims 15, 16, or 17 wherein said first and second rates are different.

19. Apparatus for producing a serial multiplexed key pulse information at a first scan rate in response to serial multiplexed key pulse information produced asynchronously at a second scan rate which may be the same as or different from the first rate, comprising:

at least first and second memories;

means for receiving the multiplexed key pulse information produced at the second rate;

first addressing means for generating a sequence of addresses for said first memory;

second addressing means for generating a sequence of addresses for said second memory;

means for storing at said second rate the received multiplexed key pulse information in said first memory at the addresses generated by said first addressing means during a first interval of time and for storing at said second rate the received multiplexed key pulse information in said second memory at the addresses generated by said second addressing means during a second distinct interval of time;

means for retrieving at said first rate the multiplexed key pulse information stored in said first memory at the addresses generated by said first addressing means during said second interval of time and for retrieving at said first rate the multiplexed key pulse information stored in said second memory at the address generated by said second addressing means during said first interval of time; and means for combining the multiplexed key pulse information retrieved from said first and second memories to produce multiplexed key pulse information at said first rate.

20. Apparatus for producing serial multiplexed key pulse information at a first scan rate in response to serial multiplexed key pulse information produced asynchronously at a second scan rate which may be the same as or different from the first rate, comprising:

at least first and second memories;

means for receiving the multiplexed key pulse information produced at the second rate;

means for alternately storing the received multiplexed key pulse information in said first and second memories at the second rate;

means for alternately retrieving the stored multiplexed key pulse information from said first and second memories at the first rate; and means for transmitting the retrieved multiplexed key pulse information to an electronic musical instrument at the first rate.

21. Apparatus for producing serial key pulse information at a first scan rate in response to serial multiplexed key pulse information produced asynchronously at a second scan rate which may be the same as or different from the first rate, comprising:

at least first and second memories;

means for receiving the multiplexed key pulse information produced at said second rate;

means for alternately storing in each of said memories at said second rate the received multiplexed key pulse information;

means for alternately retrieving from each of said memories at said first rate the multiplexed key pulse information stored therein; and means for combining the multiplexed key pulse information retrieved from said first and second memories to produce multiplexed key pulse information at said first rate.

22. Apparatus according to claims 19, 20 or 21 wherein said first and second rates are different.

* * * * *